US005884807A

United States Patent [19]

Yun

[11] Patent Number: 5,884,807

[45] Date of Patent: Mar. 23, 1999

[54] VENDING MACHINE FOR A SEQUENTIAL PURCHASE OF GOODS

[75] Inventor: Dae-Ryong Yun, Kwangju, Rep. of Korea

[73] Assignee: Kwangju Electronics Co., Ltd., China

[21] Appl. No.: 974,761

[22] Filed: Nov. 20, 1997

[30] Foreign Application Priority Data

Mar. 11, 1997 [KR] Rep. of Korea ..... 1997-8160

[51] Int. Cl.[6] ..... A47F 1/00; A47F 1/035; B65B 1/30; B65B 1/04

[52] U.S. Cl. ..... 221/96; 141/83; 141/94; 141/196; 141/156

[58] Field of Search ..... 141/83, 94, 196, 141/156; 221/96

[56] References Cited

U.S. PATENT DOCUMENTS 2,718,630 9/1955 Wait ..... 141/94
4,679,150 7/1987 Hayashi et al. ..... 194/217
4,951,719 8/1990 Wiley eta l. ..... 141/83
4,962,866 10/1990 Phillips et al. ..... 221/96
5,103,956 4/1992 Jang ..... 194/217
5,472,116 12/1995 Barbe et al. ..... 221/126

*Primary Examiner*—William E. Terrell
*Assistant Examiner*—Joe Dillon, Sr.
*Attorney, Agent, or Firm*—Perman & Green, LLP

[57] ABSTRACT

The present invention is a vending machine with the ability to accept multiple purchase requests per money transaction. As the vending machine dispensing receptacle is of limited size, a weight sensor determines if an article in the multiple dispensing sequence has been taken by the user, allowing for the subsequent article in the sequence to be dispensed. Additional features include error messages displayed to the user as well as an alarm to alert the user if an article has not been removed in some predetermined time.

4 Claims, 6 Drawing Sheets

VENDING MACHINE FOR A SEQUENTIAL PURCHASE OF GOODS

FIELD OF THE INVENTION

The present invention relates to a vending machine and, more particularly to a vending machine for sequentially providing selected articles and method therefor, thereby giving a convenience of a user.

DESCRIPTION OF THE PRIOR ART

Generally, a coffee vending machine, as shown in FIG. 1, includes a main body 1 which forms an external appearance thereof, and a hinged door 2 coupled at a front side of the main body 1 and for opening or closing the main body 1.

The door 2 has on its outer side: a door handle 3; a slit 4 for inserting coins; a beverage selection portion 5 provided with plural selection keys for selecting the desired coffees; an outlet 6 for providing the selected coffee with a user; and a coin (change) outlet 7 for providing a small change.

As shown in FIG. 2, the door 2 has inside: a coin chute 8 installed opposite to the slit 4 and for guiding coins inserted through the slit 4; and a coin mechanism 9 having a first guide member 10 which functions to discriminate whether or not the inserted coins are correct and to guide coins towards the coin outlet 7 to be returned to a user, when a user manipulates a return lever arranged at the front surface of the door 2, and a second guide member 12 for guiding the inserted coins to be deposited in a coin receiving box 11.

A coffee purchasing method using the coffee vending machine will now be described below.

After inserting coins through the slit 4, a user selects the desired coffee through the beverage selection portion 5. Then, a controller (not shown) allows a cup to be discharged in the cup outlet 6, followed the supplying of the selected coffee in the cup. The user can take the cup in which the desired coffee is filled therein. Also, the inserted coins are guided by the second guide member 12 to be stored in the coin receiving box 11, and a small change is provided to the user through the coin outlet 7.

A user may abandon his purchasing of coffee after inserting coins. For this end, a user manipulates a return lever arranged at the front surface of the door 2, by which the controller allows the inserted coins to be guided to the coin outlet 7 through the first guide member 10, so that the coffee purchasing procedures do not proceed further.

However, in case a user desires to purchase many cups of coffee, it was only possible to, at first, select only one cup of coffee as desired among many kinds of coffees (e.g., coffee with cream and sugar, coffee with sugar, black coffee, etc.), and then to select other coffee through the repeated same procedures by a user, which has caused, therefore, an inconvenience for purchasing the desired many cups of coffees.

SUMMARY OF THE INVENTION

Therefore, an object of the present invention is to provide an apparatus for a sequential purchasing of coffee for a vending machine through simple manipulation, and method therefor.

To achieve the above object of the present invention, there is provided a vending machine for providing selected articles contained therein, on condition that a certain amount of coins is inserted thereto, the machine comprising: a beverage selection portion having plural selection keys for selecting the articles therein and operational key, and for generating key signal corresponding to a key selected by a user; a control portion which stores kinds of articles inputted through the beverage selection portion and the number of articles associated therewith, and generates a control signal for allowing those information to be displayed, and which generates, in response to the operational key on the beverage selection portion, a control signal for allowing the selected articles to provided as many as the number of articles; a display portion for displaying the number of articles of the selected articles in response to a control signal from the control portion; and article providing means for providing the selected articles in response to a control signal from the control portion.

According to another aspect of the present invention, there is also provided a method for providing selected articles contained in a vending machine, the articles are selected through a selection portion thereof, on condition that a certain amount of coins is inserted thereto, the method comprising the steps of: storing kinds of selected articles and the number of articles, and displaying these information; counting a selling price corresponding to the number of articles and the selected article and the number of articles associated therewith, and comparing the counted and determined price with the total amount of money inserted, if an operational key signal is input from an operational key on the selection portion; if the inserted amount is larger than the determined price, discharging a cup and supplying a predetermined amount of raw material relating to the selected article, and if the inserted amount is less than the determined price, displaying an error message through a display portion; checking if the provided article is taken within a predetermined time interval and generating an alarm sound, if not taken, and checking if the article subsequent to the taken article is provided; and if all articles are not yet provided, providing next article.

DETAILED DESCRIPTION OF THE INVENTION

Figure 1:
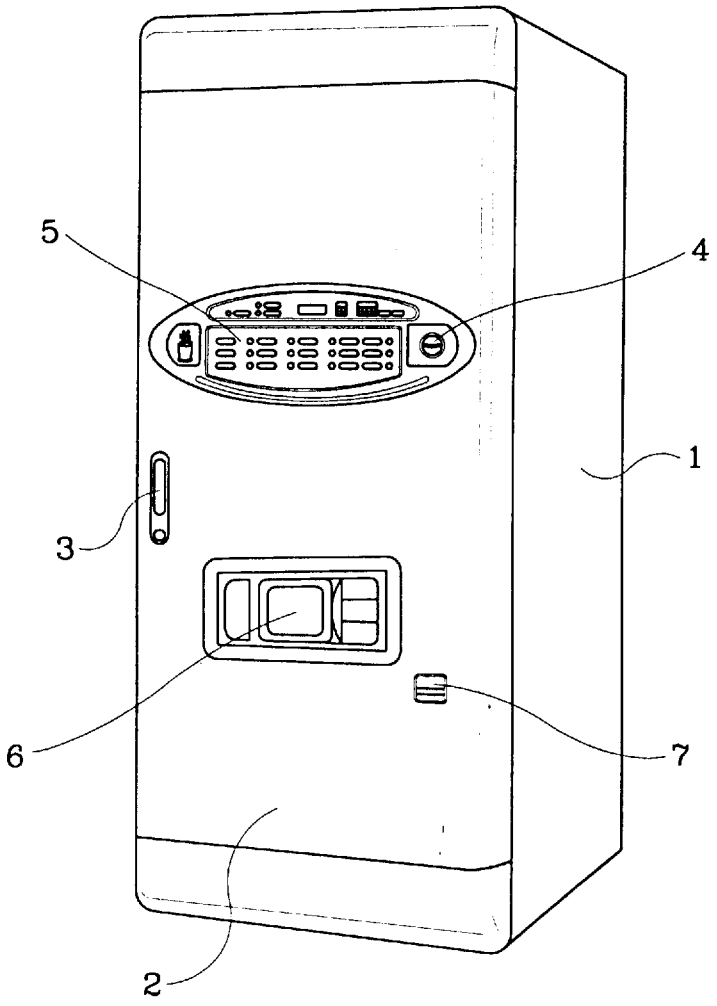
FIG. 1 is an external perspective of a conventional coffee vending machine.
Figure 2:
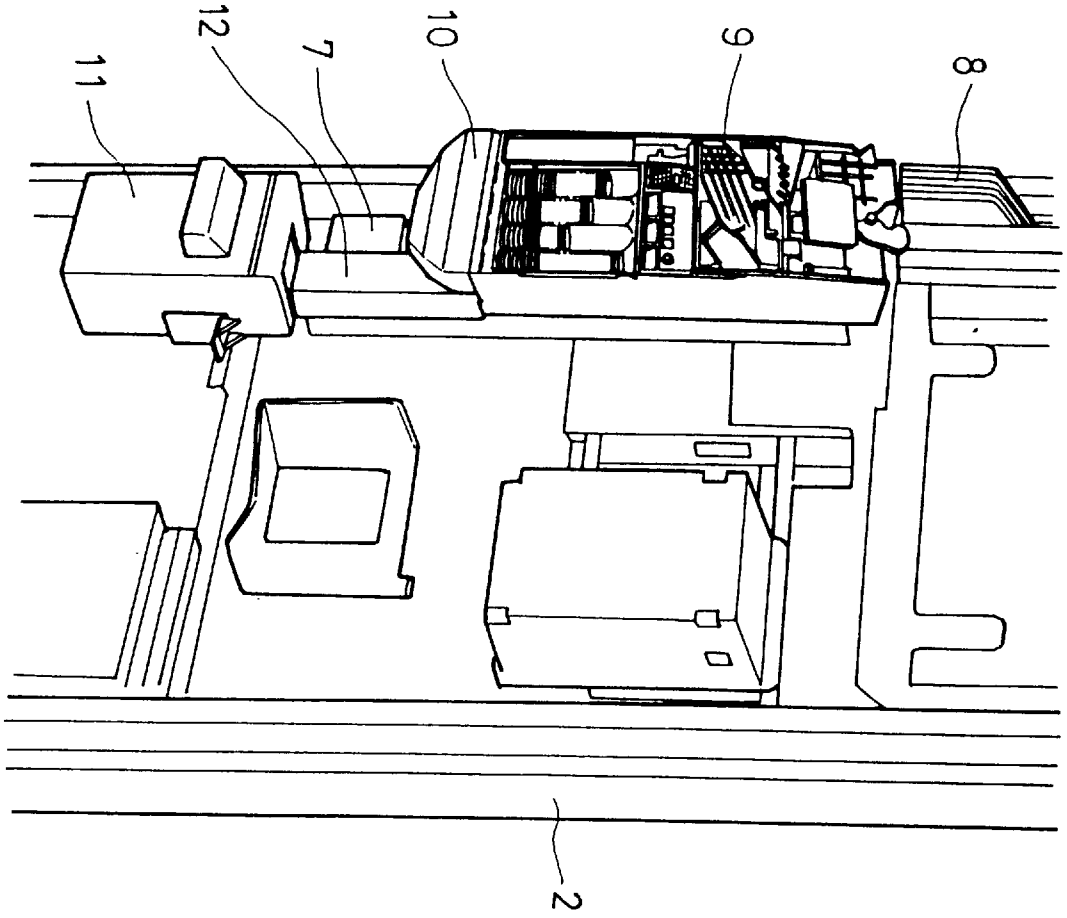
FIG. 2 is the internal perspective of the coffee vending machine in FIG. 1.

The embodiment of the present invention will now be described in detail with reference to the accompanying drawings. Throughout the drawing, like elements will be provided with like reference numerals.

Figure 3:
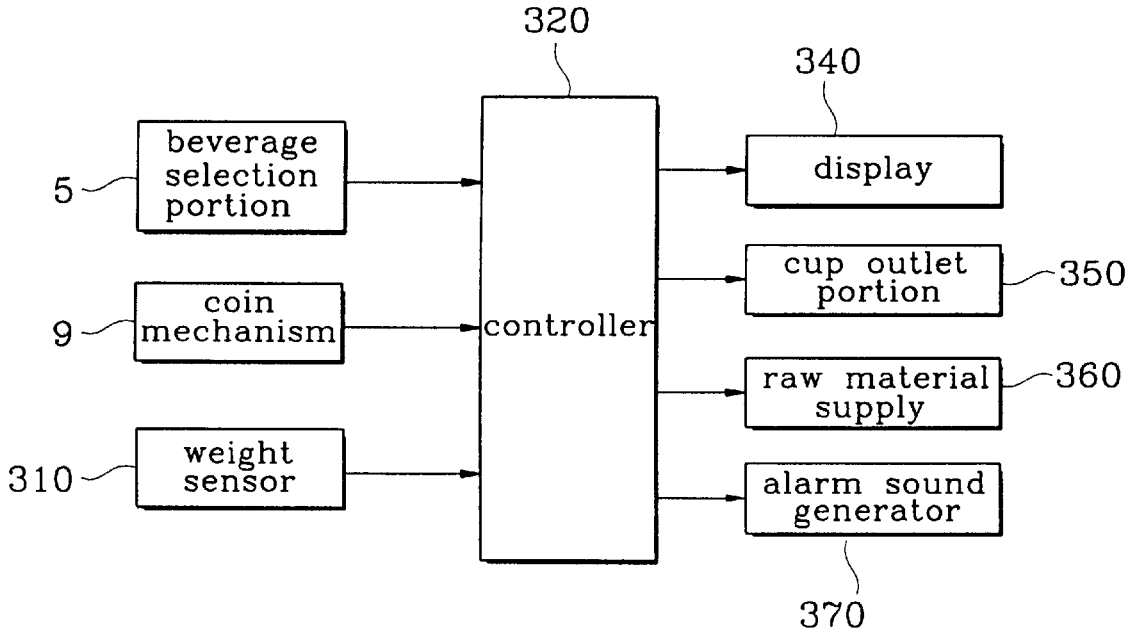
FIG. 3 is a schematic block diagram of a sequential purchasing apparatus for a vending machine in accordance with a preferred embodiment of the present invention.

FIG. 3 is a schematic block diagram of an apparatus for sequentially selling goods of the vending machine in accordance with the preferred embodiment of the present invention. The apparatus includes, as shown in the drawing, a beverage selection portion 5, a coin mechanism 9, a weight sensor 310, a controller 430, a display 350, a cup outlet portion 350, a raw material supplying portion 360, and alarm sound generating portion 370.

The beverage selection portion 5 with selection keys further includes an operational key. The coin mechanism 9 is substantially identical with the conventional one, therefore whose details are omitted.

Referring to FIG. 3, the weight sensor 310 is installed at a predetermined lower portion of the cup outlet 6, and senses the cup weight in the cup outlet 6 and forwards electrical signal corresponding to the measured weight to the controller 320.

The controller 320 stores data designating kinds of coffees and the number of cups selected from the beverage selection portion 5, and generates signals for displaying the selected data. Further, the controller 320 allows each cup to be discharged in response to the operational key signal provided from the beverage selection portion 5, and then outputs a control signal for supplying raw material corresponding to kinds of coffee selected.

In case the operational key signal is input from the beverage selection portion 5 to the controller 320, the controller 320 compares the predetermined selling price determined by kinds of selected coffee and the number of cups with the amount of coins inserted though the slit 4 and sensed by the coin mechanism 9, and, if the total amount from a user is less than the predetermined price, generates a control signal for displaying a certain error message to the display 340.

Further, the controller 320 utilizes the weight sensor 310 to sense if the cup is provided in the cup outlet 6. If the cup is taken by a user, the controller allows another cup to be again discharged in the outlet 6, and then generates a control signal for supplying raw material corresponding to a user-selected coffee into the discharged cup. However, in some cases, the cup provided in the outlet 6 may not be taken by a user until the predetermined time lapses, and then the controller 320 generates a control signal for generating a warning sound.

The display 340 displays error messages in response to a control signal from the controller 320 and the number of cups selected by a user.

The cup outlet portion 350 is operated to discharge the cup in response to a control signal from the controller 320.

The raw material supplying portion 360 supplies raw material corresponding to kinds of coffee selected based upon a control signal from the controller 320.

The alarm sound generating portion 370 generates an alarm sound in response to a control signal from the controller 320.

Figure 4A:
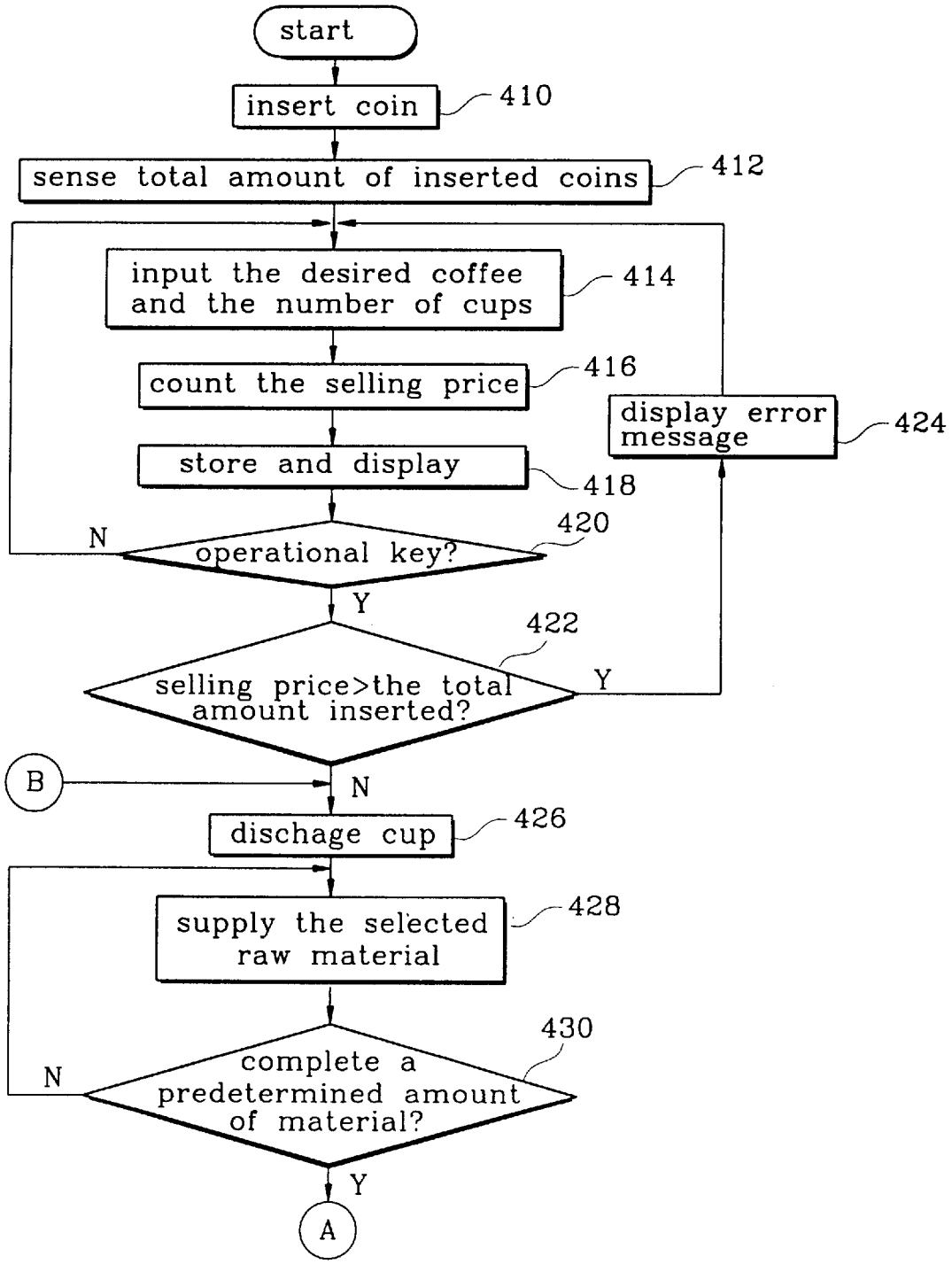
FIGS. 4A and 4B are a flow chart for explaining processing procedures for sequentially providing many cups of coffee according to the present invention.
Figure 4B:
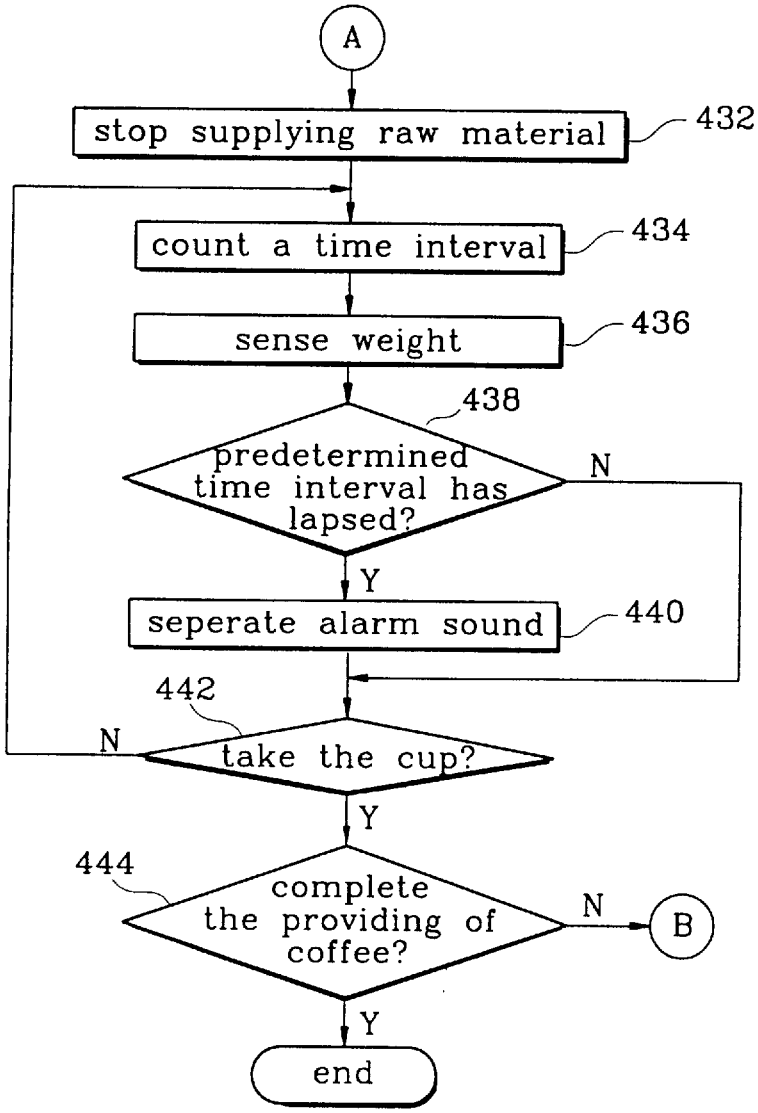
Figure 5:
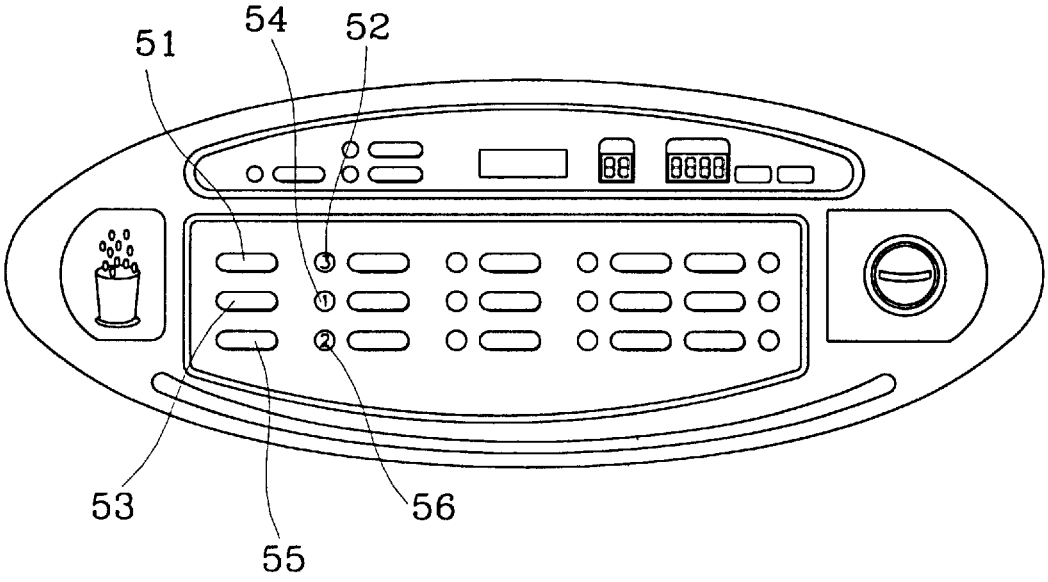
FIG. 5 is a diagram for explaining one example sequentially selling coffees according to the present invention.

The construction of the sequential purchasing apparatus for the vending machine and method therefor in accordance with the present invention will now be described below, with reference to FIGS. 3 through 5.

If a user inserts coins into the slit 5 (step 410), the inserted coins travel through the coin chute 8 and are guided to the coin mechanism 9, where the total amount of the inserted coins is sensed. A sensed signal is provided to the controller 320, thereby allowing the controller 320 to know the total amount (step 412).

Next, a user usually selects the desired coffee and then the number of cups by repeatedly pressing a selection key on the beverage selection portion 5, which allows the selection key signal corresponding thereto to be generated and provided to the controller 320 (step 414). The controller 320 senses the selection key signal from the beverage selection portion 5, counts the selling prices corresponding to the selected coffee and number of cups (step 416), stores data representing the number of cups as well as the selected coffee, and generates a control signal for displaying the data to be stored (step 418).

The controller 320 checks if the operational key signal is input from the beverage selection portion 5 (step 420), and in case said signal is provided, the controller 320 compares the counted and determined selling price with the sensed amount of the inserted coins (step 422).

If it is determined that the sensed total amount is less than the determined selling price, the controller 320 generates a control signal for displaying an error message therefor which is displayed on the display 424 in response thereto (step 424).

If it is determined that the sensed total amount is not less than the determined selling price, the controller 320 allows the cup to be discharged and generates a control signal for supplying raw material corresponding to the selected coffee. A cup is discharged from the cup outlet portion 350 and seated in the cup outlet 6 under the control of the controller 320, followed by the supplying of the selected raw material (step 428).

The predetermined amount of raw material (i.e., a cup of coffee) is supplied from the raw material supplying portion 360 (steps 430 and 432), during which the controller 320 counts a time interval using an internal timer (step 434). At this time, the weight sensor 310 senses the total weight of cup containing the contents therein and outputs it to the controller 320 (step 436).

The controller 320 checks if the predetermined time interval has lapsed (preferably, about 3 seconds) (step 438). If the time interval measured through the internal timer exceeds the reference value, the controller generates a control signal for generating an alarm sound by the alarm sound generating portion 370 (step 440).

The time interval is measured until the time reaches the preset time, during which the controller 320 checks, based upon a sensing signal provided from the weight sensor 310, if the cup discharged in the cup discharging outlet 6 is taken by a user (step 442).

More specifically, the weight sensor 310 at the lower portion of the cup discharging outlet 6 senses a change in weight when the cup is taken by a user, by which the controller 320 can check whether the cup is taken by a user or not.

However, in case the cup is not taken by a user, flow returns to step 434, where steps subsequent to step 434 are repeated, and then at step 444, if the cup is taken by a user, the controller 320 checks if the selling of coffee is completed.

At step 444, if the number of cups are not yet provided to a user, flow returns to step 426 where respective steps 428, 430, 434, 436, 438, 440, 442 and 444 are executed, so that various coffees selected by a user are automatically and sequentially provided to a user.

A preferable example is given below, which will be described with reference to FIG. 5.

It is assumed that a user desires to sequentially obtain six cups, i.e., three cups of coffee with milk and sugar, one cup of coffee with cream and one cup of black coffee (200-won per cup). Then, a user inserts coins, 1200-won into the slit 4, of which the total amount are then sensed by the coin mechanism 9, and the sensed data is provided to the controller 320.

Next, if a user presses three times selection key 51 corresponding to coffee with milk and sugar, the controller

320 allows the number of cups, "3", to be displayed through the display 52, and stores associated data, three cups of coffee, therein. Likewise, other kinds of coffee and the number of cups are sequentially selected through the same procedures as mentioned above.

After completing the selection, a user presses the operational key on the beverage selection portion 5. Then, based upon the operational key signal, the controller 320 allows the cup to be discharged, and generates a control signal for supplying raw material corresponding to the coffee with milk.

After completing the supplying of a predetermined amount of raw material into the cup, the controller 320 drives the internal timer used for counting a predetermined time interval. If 3 seconds have lapsed, which is measured using the internal timer, the cup weight is sensed by the weight sensor 310.

If a user takes the cup in the cup outlet 6, a change in weight of the cup is sensed through the weight sensor 310, so that the controller 320 can know if the cup is taken by a user.

If the cup still remains in the cup discharging outlet 6 even after the predetermined time interval has lapsed, a control signal from the controller 320 allows the warning sound by the alarm sound generating portion 370 to be generated. A user hears the warning sound generated, thereby allowing the cup to be taken by a user.

The completion of such procedures is followed by the repeated same procedures until the remaining two cups of coffee with milk are completely provided to a user. Likewise, the next coffee with cream and black coffee can be automatically and sequentially provided to a user by the above procedures.

While particular application of the present invention has been illustrated and described with respect to the coffee vending machine, it can be readily seen from the foregoing that the invention is not limited thereto, but is applicable to the can vending machine, snack vending machine, etc.

According to the present invention, a simple manipulation by a user makes it possible to sequentially purchase the desired goods, so that a convenience to the user is given.

What is claimed is:

1. A vending machine for providing selected articles contained therein, on condition that a certain amount of coins are inserted thereto, the machine comprising:

a selection portion having plural selection keys for selecting the articles therein and an operational key, for generating key signal corresponding to a key selected by a user;

a control portion which stores information comprising kinds of articles inputted through the selection portion and or the number of articles associated therewith, generates a control signal for allowing said information to be displayed, and which generates, in response to the operational key on the selection portion, a control signal for allowing the selected articles to be provided in accordance with the number of articles selected by the user, a control signal for displaying an error message, a control signal for sounding an alarm;

a display portion for displaying the number of articles of the selected articles in response to one of said control signals from the control portion; and article providing means for providing the selected articles in response to one of said control signals from the control portion.

2. The vending machine of claim 1, wherein the machine further comprises article provision sensing means for discriminating whether or not the provided articles are taken by a user.

3. The vending machine of claim 2, wherein the article provision sensing means comprises a weight sensor.

4. A method for providing selected articles contained in a vending machine, the articles are selected through a selection portion thereof, on condition that a certain amount of coins are inserted thereto, the method comprising the steps of:

storing information comprising kinds of selected articles and the number of articles, and displaying by information;

counting a selling price corresponding to the number of articles and the selected article and the number of articles associated therewith, and comparing the counted and determined price with the total amount of money inserted, if an operational key signal is input from an operational key on the selection portion;

if the inserted amount is larger than the determined price, discharging a cup and supplying a predetermined amount of raw material relating to the selected article, and if the inserted amount is less than the determined price, displaying an error message through a display portion,;

checking if the provided article is taken within a predetermined time interval and generating an alarm sound, if not taken, and checking if the article subsequent to the taken article is provided; and providing next article, if all articles are not yet provided.

* * * * *